United States Patent [19]

Clark et al.

[11] Patent Number: 4,774,436

[45] Date of Patent: Sep. 27, 1988

[54] MAGNETRONS

[75] Inventors: Michael J. Clark, Watford; Edward Sobieradzki; Christopher W. Howard, both of London, all of United Kingdom

[73] Assignee: The M-O Valve Company Limited, England

[21] Appl. No.: 57,427

[22] Filed: Jun. 2, 1987

[30] Foreign Application Priority Data

Jun. 9, 1986 [GB] United Kingdom ..... 8613967

[51] Int. Cl.[4] ..... H01J 25/58

[52] U.S. Cl. ..... 315/39.65; 315/39

[58] Field of Search ..... 315/39, 39.51, 39.65, 315/39.75, 39.67, 39.77, 39.73

[56] References Cited

U.S. PATENT DOCUMENTS

| | | | |
|---|---|---|---|
| 2,493,661 | 1/1950 | Espersen | 315/39.65 |
| 2,548,808 | 4/1951 | Nichols | 315/39.75 |
| 2,626,372 | 1/1953 | Spencer | 315/39.65 |
| 3,293,487 | 12/1966 | Pickering | 315/39.65 |
| 3,327,161 | 6/1967 | Kakizawa | 315/39.65 |
| 3,600,629 | 8/1971 | Fenster et al. | 315/39.65 |
| 3,608,167 | 9/1971 | Safran et al. | 315/39.65 |

*Primary Examiner*—David K. Moore

*Attorney, Agent, or Firm*—Kirschstein, Kirschstein, Ottinger & Israel

[57] ABSTRACT

The present invention concerns a rising sun magnetron comprising an anode ring having a series of radially inwardly-projecting teeth-like elements of a relatively high thermal coefficient of expansion. Each element (27) has a vane (21) of material of relatively low thermal coefficient of expansion secured on either side thereof so as to define alternate long and short cavities and an associated length of material (26) also of low coefficient of thermal expansion lying between the adjacent pair of vanes (21) and acting as a fulcrum for the associated vanes when the element (27) expands due to temperature rises.

4 Claims, 1 Drawing Sheet

MAGNETRONS

BACKGROUND OF THE INVENTION

1. Field of the Invention

The present invention concerns magnetrons. These are high vacuum devices containing a cathode and an anode, the latter normally being divided into a plurality of segments. The magnetron provides a resonant system in which the interaction of an electronic space charge with the resonant system converts direct-current power into alternating-current power at microwave frequencies.

2. Description of Related Art

There are two main generic types of magnetron in current use. The first type is known as the "Strapped Vane" and the second as the "Rising Sun" type of magnetron. Strapped vane magnetrons are potentially more efficient than rising sun magnetrons but are increasingly difficult to fabricate when high frequencies are required.

SUMMARY OF THE INVENTION

The present invention is concerned with magnetrons of the rising sun type. In this type of magnetron the anode is in the form of a ring from which extend inwardly a plurality of vanes. The vanes define a series of cavities which are of alternating length and known respectively as long and short cavities.

As is well known the resonant $\pi$-mode frequency in a rising sun magnetron is a function of the geometry of the long and short cavities. Thus the temperature coefficient of such a magnetron, discounting end-space effects, is generally equal to the linear coefficient of expansion of the anode material.

An object of the present invention is to provide a rising sun magnetron in which its temperature coefficient can be selected. In many cases it will be preferable for the magnetron frequency to be unaffected by temperature changes, at least within a specified range.

Accordingly the present invention consists in a rising sun magnetron comprising an anode ring having a series of radially inwardly-projecting teeth-like elements of a relatively high thermal coefficient of expansion, each of which has a vane, made from a material having a low thermal coefficient of expansion, secured on either side thereof so as to define alternate long and short cavities, and wherein each element has an associated length of material also of a low thermal coefficient of expansion which lies between the vanes mounted on the element and which acts as a fulcrum for the associated vanes when the element expands due to temperature rises.

According to a feature of the invention the anode ring may be of a composite structure, and may include a ring of a material of low thermal coefficient of expansion as well as material such as copper having a relatively high thermal coefficient of expansion.

The teeth-like elements may be of copper whilst the material with the low thermal coefficient of expansion may be molybdenum, tungsten or an alloy.

BRIEF DESCRIPTION OF THE DRAWINGS

In order that the invention may be more readily understood, an embodiment thereof will now be described by way of example and with reference to the accompanying drawings, in which.

DETAILED DESCRIPTION OF THE PREFERRED EMBODIMENT

Figure 1:
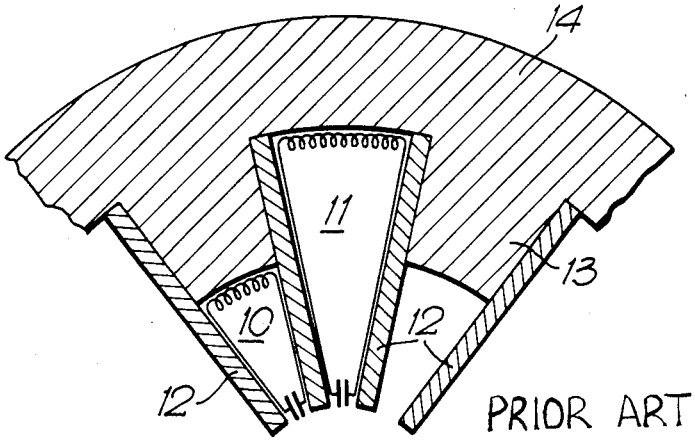
FIG. 1 shows part of the anode of a known rising sun magnetron according to the prior art.

Referring now to FIG. 1 of the drawings this shows two adjacent cavities of a known rising sun magnetron, cavity 10 being a short cavity and cavity 11 a long cavity. The cavities are defined by copper vanes 12 extending on either side of teeth-like elements 13 which are formed on a copper anode ring 14. In operation of the magnetron the cavities act as inductive circuits. These notional circuits are indicated in the figure and essentially consist of an inductive element located at the base of each cavity and a capacitive element located between respective vane tips.

In this known construction thermal expansion of the anode material causes corresponding changes of the anode dimensions, thus giving the magnetron its unwanted thermal coefficient.

One way of counteracting thermal expansion is to use a material with a very low coefficient of thermal expansion for the construction of the anode. One such material is molybdenum. However, molybdenum and other similar materials are very difficult to machine, and the microwave conducting surfaces must be copper-clad to maintain a high figure of merit ($Q_o$) to the $\pi$-mode resonance.

Figure 2:
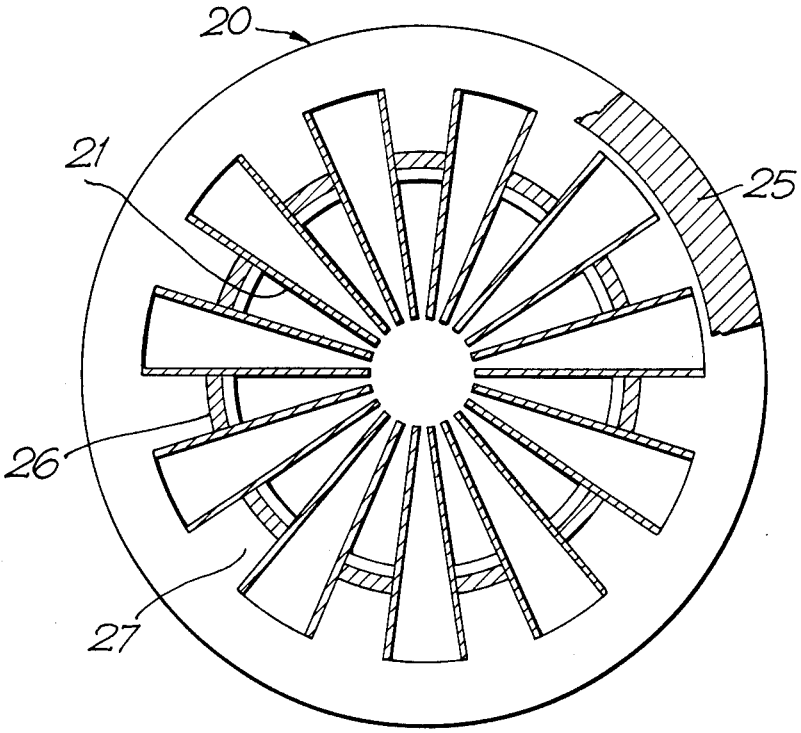
FIG. 2 is a plan view of a rising sun magnetron constructed in accordance with the present invention.

The present invention thus proposes a composite anode structure which incorporates both a material like molybdenum with copper and which exploits the differing thermal coefficients of expansion of the materials employed to achieve a compensation effect by varying the inter-vane capacitance. One example of such a structure is shown in FIG. 2 of the drawings.

This figure shows an anode 20 for a rising sun magnetron. The anode 20 is partly of copper and partly of molybdenum. The areas fabricated from molybdenum are shown shaded and the remainder of the anode is of copper. The twenty-two equally spaced vanes 21, though shown as molybdenum, are coated with copper to maintain the required figure of merit $Q_o$. It can thus be seen that the main body of the anode 20 contains a ring 25 of molybdenum which extends around the entire circumference of the anode.

The anode 20 also includes eleven ring segments 26 located on the apices of the teeth-like elements 27 projecting inwardly from the main anode body. As can be seen these are also of molybdenum.

In operation the behaviour of the magnetron when subjected to increased temperature is as follows: distortion in the length of the cavities is determined by the linear expansion coefficient of the vane material and, other factors being equal, the magnitude of the temperature coefficient of frequency of the magnetron would take this value.

If the ring segments 26 were not present, the expansion of the elements 27 would force the tips of the two vanes on either side of each element 27 outwardly. The effect of this outward movement is to increase the capacitive element of the long cavity (FIG. 1) and decrease that of the short cavity. As the long cavity has the greatest effect on the thermal coefficient of frequency of the magnetron this would have a substantial effect on the thermal coefficient.

The ring elements, however, act as fulcra about which the thermally induced stresses pivot the vanes 21. Thus the tips of the vanes 21 tend to move in the opposite direction than that described in the case where the ring elements 27 were absent. It will be appreciated that the balance of forces can be varied by changing the lengths of the segmental ring elements 27. Thus by appropriately choosing the lengths of elements 27 the frequency deviation which would occur due to changes in cavity lengths can be almost exactly compensated for. Alternatively, a thermal frequency coefficient of chosen value can be established.

In the foregoing description the vanes 21, ring 25 and segmental ring elements have been described as being of molybdenum. It will be appreciated that there are alternative materials with a low thermal coefficient of expansion which can be used. Thus tungsten may replace the molybdenum. Alternatively, a matching alloy can be used. Such an alloy could be a combination selected from Copper, Tungsten and Molybdenum.

We claim:

1. A magnetron of the rising sun type, comprising:

(a) an anode ring, (b) a plurality of teeth-like elements of a material of high coefficient of thermal expansion regularly spaced around and projecting inwardly of said anode ring, (c) a plurality of vanes of a material of a relatively low coefficient of thermal expansion mounted on either side of each of said elements so as to define alternate long and short cavities, and (d) means for varying inter-vane capacitance as a function of temperature, including a plurality of lengths of material also of a relatively low coefficient of thermal expansion mounted on the innermost ends of each of said elements, each said length acting as a fulcrum about which two vanes associated therewith can pivot when the element on which each said length is mounted expands as a result of a rise in temperature, such pivotal movement varying the inter-vane capacitance in such a manner as to at least partially compensate for the temperature rise.

2. A magnetron of the rising sun type, comprising:

(a) an anode ring including an outer ring of a material of relatively low coefficient of thermal expansion, and an inner ring of a material of a relatively high coefficient of thermal expansion;

(b) a plurality of teeth-like elements of a material of high coefficient of thermal expansion regularly spaced around and projecting inwardly of said anode ring;

(c) a plurality of vanes of a material of a relatively low coefficient of thermal expansion mounted on either side of each of said elements so as to define alternate long and short cavities; and (d) a plurality of lengths of material also of a relatively low coefficient of thermal expansion mounted on the innermost ends of each of said elements, each said length acting as a fulcrum for the vanes associated therewith when the element on which it is mounted expands as a result of a rise in temperature.

3. A magnetron as claimed in claim 2 wherein the inner ring is of copper.

4. A magnetron as claimed in claim 3 wherein the material of low coefficient of thermal expansion is selected from the group containing molybdenum, tungsten and molybdenum/tungsten alloy.

* * * * *